US010517360B1

(12) United States Patent
Bethany

(10) Patent No.: US 10,517,360 B1
(45) Date of Patent: Dec. 31, 2019

(54) KEEPSAKE

(71) Applicant: Life Tribute Tears, LLC, Roswell, NM (US)

(72) Inventor: Jerel Bethany, Roswell, NM (US)

(73) Assignee: Life Tribute Tears, LLC, Roswell, NM (US)

( * ) Notice: Subject to any disclaimer, the term of this patent is extended or adjusted under 35 U.S.C. 154(b) by 0 days.

(21) Appl. No.: 14/987,700

(22) Filed: Jan. 4, 2016

Related U.S. Application Data

(60) Provisional application No. 62/100,826, filed on Jan. 7, 2015, provisional application No. 62/099,277, filed on Jan. 2, 2015.

(51) Int. Cl.

| | |
|---|---|
| ***A44C 25/00*** | (2006.01) |
| ***A61G 99/00*** | (2006.01) |
| ***A44C 27/00*** | (2006.01) |
| ***A61G 17/08*** | (2006.01) |

(52) U.S. Cl.
CPC ..... *A44C 25/002* (2013.01); *A44C 27/00* (2013.01); *A61G 17/08* (2013.01); *A61G 99/00* (2013.01)

(58) Field of Classification Search
CPC ..... A61G 17/08; A61G 99/00; A45C 25/002; A45C 27/00; A44C 25/002; A44C 27/00; A44C 15/00
USPC ..... 27/1; 63/1.14, 1.11, 1.18
See application file for complete search history.

(56) References Cited

U.S. PATENT DOCUMENTS

| | | | | |
|---|---|---|---|---|
| 4,502,298 | A * | 3/1985 | Benton | A24F 19/0064 224/219 |
| 5,208,957 | A * | 5/1993 | Hereford | A44C 25/00 206/37 |
| 5,755,116 | A * | 5/1998 | Sparacino | A44C 5/003 63/1.14 |
| 5,950,287 | A * | 9/1999 | Cacciatore | A44C 25/002 27/1 |
| 7,191,498 | B2 | 3/2007 | Fischer | |
| 7,228,602 | B2 | 6/2007 | Weisbrot et al. | |
| 7,467,444 | B1 * | 12/2008 | Johnson, Sr. | A44C 23/00 27/1 |
| 7,562,423 | B2 | 7/2009 | Pryd-Kakuk | |
| 7,610,663 | B2 | 11/2009 | Johnson, Sr. | |
| 7,861,385 | B1 | 1/2011 | Meyer | |
| 7,950,117 | B2 * | 5/2011 | Elhaj | A61G 17/08 27/1 |
| 7,997,100 | B2 * | 8/2011 | Fossas | A44C 25/002 206/19 |

(Continued)

FOREIGN PATENT DOCUMENTS

| | | |
|---|---|---|
| CN | 2785582 Y | 6/2006 |
| DE | 10001506 B4 | 7/2006 |

OTHER PUBLICATIONS

"About Madelyn Jewelry—The Original Keepsake Pendant", http://www.memorialjewellery.com.au.

(Continued)

*Primary Examiner* — William L Miller

(74) *Attorney, Agent, or Firm* — Deborah A. Peacock; Justin R. Jackson; Peacock Law P.C.

(57) ABSTRACT

A keepsake article of jewelry with a cavity finable with cremated remains, hair and/or personal effects of a deceased or living person or animal that is sealed with an adhesive or cement. Optionally, the keepsake article of jewelry comprises a teardrop shape and a jewelry finding.

15 Claims, 3 Drawing Sheets

(56) References Cited

U.S. PATENT DOCUMENTS

| | | | | |
|---|---|---|---|---|
| 8,125,774 | B2 | 2/2012 | Kelley et al. | |
| 8,281,465 | B1 * | 10/2012 | Miraldi | A61G 17/08 27/1 |
| 8,627,555 | B2 | 1/2014 | Kennedy | |
| 2004/0045316 | A1 * | 3/2004 | Naor | A44C 25/002 63/1.14 |
| 2005/0092023 | A1 * | 5/2005 | Camargo | A44C 11/00 63/37 |
| 2005/0279136 | A1 | 12/2005 | Bowman | |
| 2006/0207075 | A1 | 9/2006 | Davis | |
| 2006/0266079 | A1 | 11/2006 | Lavictoire | |
| 2007/0080077 | A1 | 4/2007 | Thormahlen | |
| 2009/0266108 | A1 | 10/2009 | Balme et al. | |
| 2010/0199476 | A1 | 8/2010 | Cummings et al. | |
| 2010/0275649 | A1 * | 11/2010 | Eggleston | A44C 25/002 63/1.14 |
| 2011/0132036 | A1 * | 6/2011 | Meltzer | A44C 17/0233 63/29.1 |
| 2011/0277502 | A1 * | 11/2011 | Welikson | A44B 1/14 63/1.18 |
| 2012/0137560 | A1 | 6/2012 | Denton et al. | |
| 2015/0052946 | A1 * | 2/2015 | Reid, II | A44C 27/007 63/26 |
| 2015/0209211 | A1 * | 7/2015 | Savage | A61G 17/08 27/1 |

OTHER PUBLICATIONS

Cremation Jewelry Designs, "Star Seed Gems", http://www.starseedgems.com.

* cited by examiner

KEEPSAKE

CROSS-REFERENCE TO RELATED APPLICATIONS

This application claims priority to and the benefit of the filing of both: U.S. Provisional Patent Application Ser. No. 62/099,277, entitled "MEMORIAL KEEPSAKE", filed on Jan. 2, 2015, and the specification thereof is incorporated herein by reference; and U.S. Provisional Patent Application Ser. No. 62/100,826 entitled "MEMORIAL KEEPSAKE", filed on Jan. 7, 2015, and the specification thereof is incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

Field of the Invention (Technical Field)

The present invention relates to keepsake objects (preferably memorial keepsake objects) and methods of manufacture of same.

BRIEF SUMMARY OF THE INVENTION

Embodiments of the present invention comprise molded keepsake articles of jewelry comprising a shape, a molded cavity fillable with cremated remains, hair and/or personal effects of a deceased or living person or animal, an adhesive to seal the finable cavity, and a jewelry finding (e.g., a bail) disposed over the adhesive to cover it. In one embodiment, the articles of jewelry further comprise a birthstone color for the birthday of said deceased or living person or animal. One preferred embodiment is a geometric and/or teardrop shape. The articles of jewelry are preferably manufactured of stone, plastic, fired glass, metals, etc. When the keepsake articles of jewelry comprise a teardrop shape, the cavity is preferably located in the narrow portion of the teardrop shape.

A different embodiment of the present invention comprises a kit for making a keepsake wherein a cavity is provided open for a consumer or funeral professional to fill in the cavity with cremated ashes, hair and/or personal effects of a deceased person or animal, adhesive for applying after filling said open cavity, a jewelry finding for covering the adhesive, and user instructions.

Embodiments of the invention further comprise a method of manufacturing a keepsake article of jewelry comprising obtaining cremains, hair and/or personal effects of a deceased or living person or animal, casting an article of jewelry comprising a cavity, filling the cavity with the cremains, hair and/or personal effects of a deceased or living person or animal, sealing the cavity with an adhesive or cement, and placing a finding on the adhesive or cement to cover it.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

This invention relates to a keepsake article of jewelry or a similar item, including but not limited to a pendant, pin, tie tack, lapel pin, token (for pocket), earring(s), other jewelry and the like. The invention preferably comprises a teardrop shaped item, but can be of any shape. The item can be drilled or has a cavity resulting from molding or pre-drilling. The cavity in the item preferably is filled with "cremains" (cremated ashes), hair and/or personal effects of a deceased or living person or animal. The cavity is preferably then sealed with an adhesive and preferably, and alternatively, a jewelry finding (e.g. a bail) is disposed over the sealed area. The term "adhesive" as used throughout the specification and claims is intended to include adhesive, glue, cement, moldable and curing materials, epoxies, and the like. The terms "keepsake" and "memorial keepsake" may be interchangeably used throughout the specification.

Materials such as stone, plastic, glass, or metals are preferably drilled or molded to form a cavity, which cavity is then filled with ashes or other substances. The holes or cavities are preferably sealed by using adhesive or cement after placing the cremated ashes or any other memorable substances therein. In an alternative embodiment, the substance (e.g. cremains) is mixed with an adhesive or sealing substance which then cures or dries to seal the cavity. If a single cavity is created, it is preferably located in the narrow portion of the keepsake.

Figure 1:
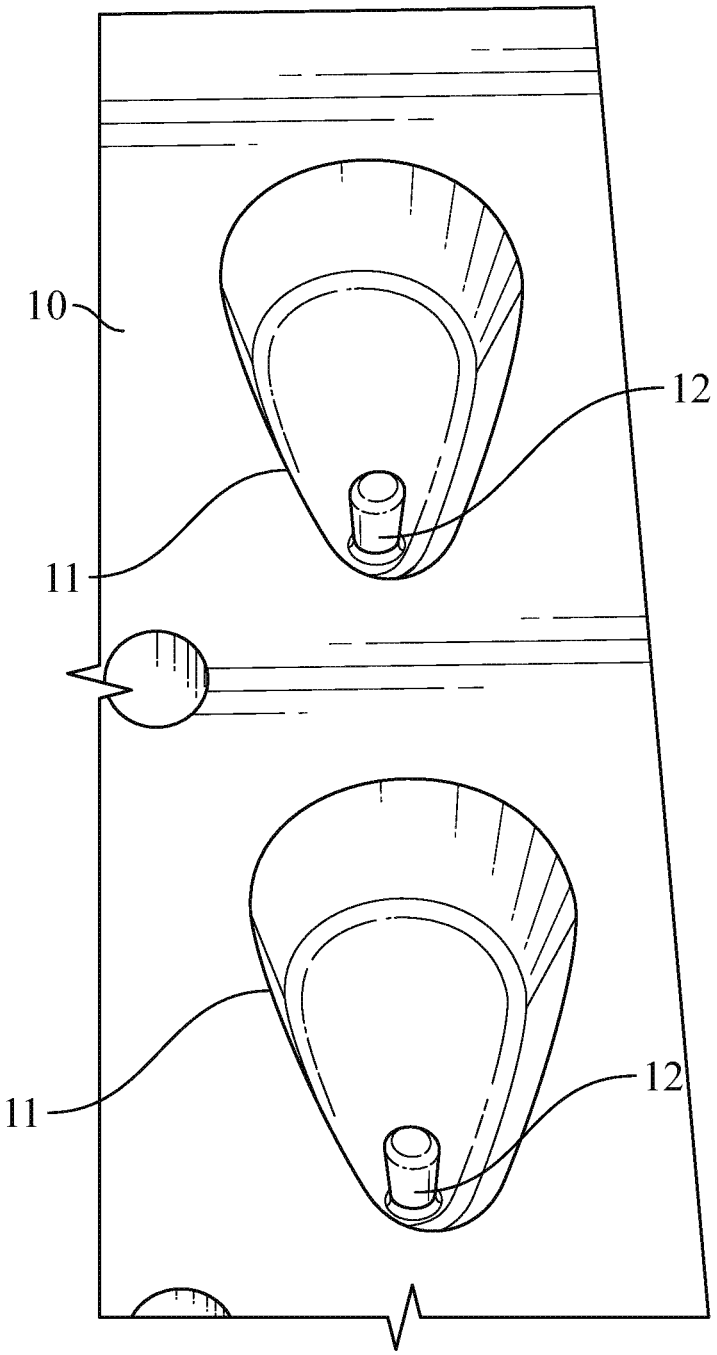
FIG. 1 is a perspective view of a mold for simultaneously making one or more copies of a memorial keepsake of the present invention.

As shown in FIG. 1, one or more memorial keepsakes can be molded at once via mold 10 with one or more hollows 11, and each memorial keepsake preferably comprises at least one cavity formed during the molding process by posts 12.

The resulting preferred teardrop shape is disclosed in FIG. 1 via the resulting shape from the mold illustrated.

An embodiment of the invention is the fabrication of memorial keepsakes comprising the steps of; obtaining cremains, hair and/or personal effects of a deceased or living person or animal; casting or molding or providing an article of jewelry comprising a cavity; filling the cavity with the cremains, hair and/or personal effects of a deceased or living person or animal; sealing the cavity with an adhesive or cement; and disposing a finding over the adhesive or cement to cover the cavity.

The invention is further directed to a kit for making the memorial keepsake, which would comprise the keepsake body (preferably with the drilled hole although the user could do the molding and/or cavity formation e.g. drilling), any jewelry finding (if the keepsake memorial is jewelry or an accessory) and, alternatively, the adhesive or cement. The kit would also include instructions for filling the keepsake with the cremains or other items, and sealing it or mixing it with the adhesive/cement.

In an alternative embodiment, the memorial keepsake may have the birthstone color for the birthday of the person being memorialized or remembered. The memorial keepsake can be for human or animal remains or mementos of a living or deceased person or animal, or for other items that the buyer may want to keep as a memory.

Figure 2:
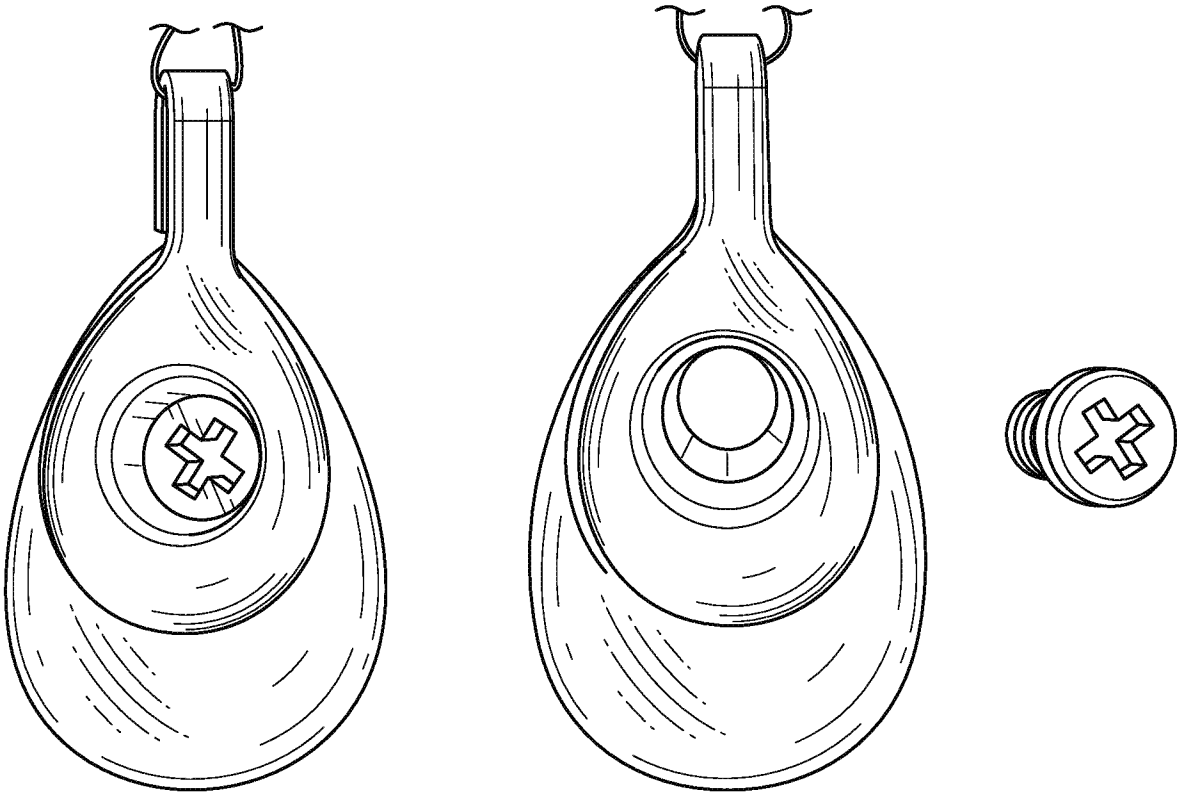
FIG. 2 shows an embodiment of a fired glass memorial keepsake with and without a screw attaching a finding to adhesive covering a filled cavity.

Referring to FIG. 2, the drawing shows the cavity (filled with the item) covered by a jewelry finding. Optionally, the finding is further secured with, for example, a screw inserted into the adhesive or cement. In FIG. 2, a cavity filled with cremains is covered by a finding with a top bail that is screwed in place and covers the adhesive.

Figure 3:
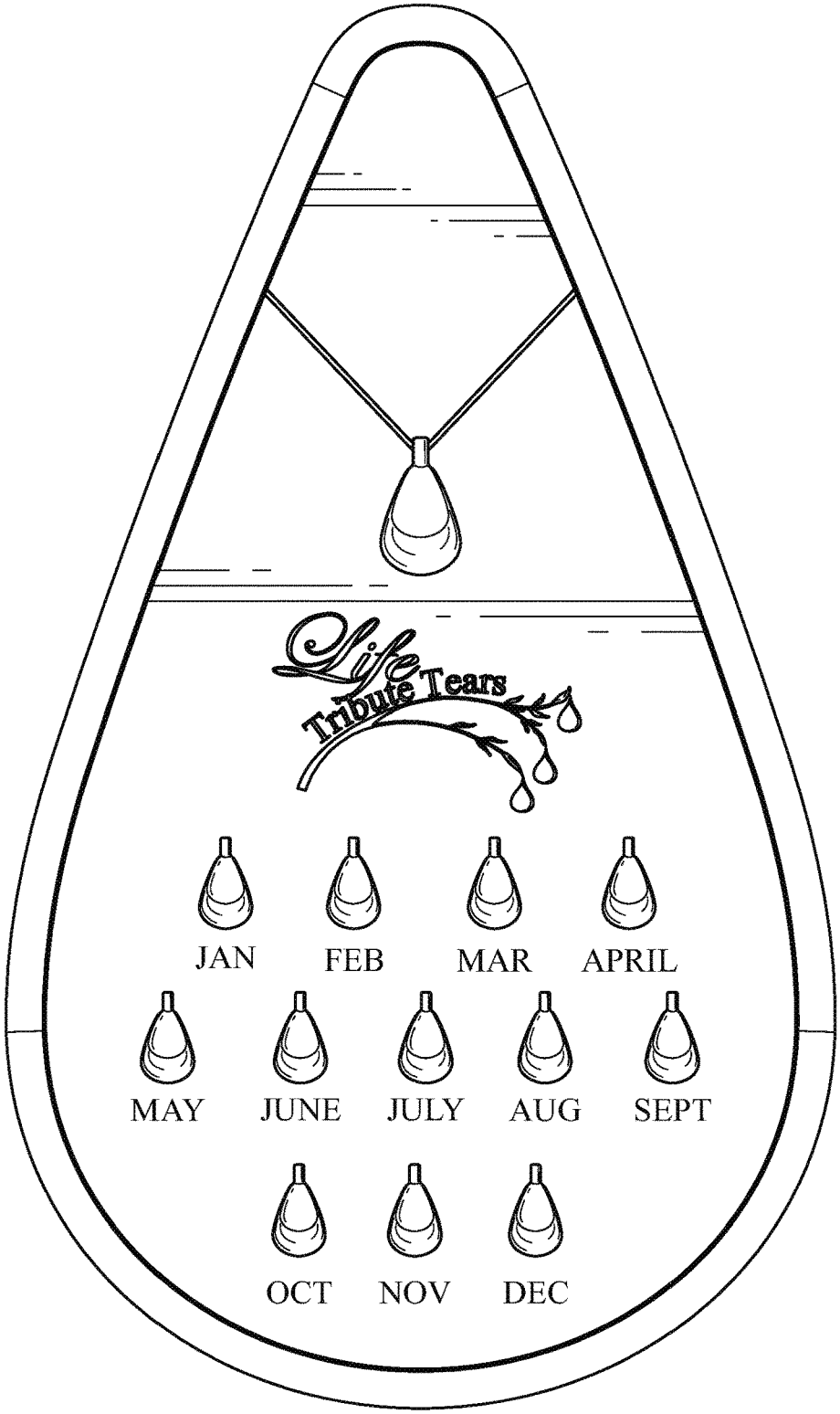
FIG. 3 is a display comprising several memorial keepsakes.

Referring to FIG. 3, in a different embodiment, the memorial keepsake is affixed to, or hung in a display (e.g. a point of sale display).

INDUSTRIAL APPLICABILITY

The invention is further illustrated by the following non-limiting examples.

Example 1

A fired glass teardrop shaped memorial keepsake article comprising a Tillable cavity was fabricated by casting fired glass in the mold of FIG. 1. After it cooled, the cavity on the article was then filled with cremains of a deceased person and sealed with an adhesive. A jewelry bail was placed over the adhesive to cover it. The color of the glass was the birth stone color of the deceased person.

The preceding example can be repeated with similar success by substituting the generically or specifically described components and/or parameters of this invention for those used in the preceding examples.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A keepsake article of jewelry comprising:

a necklace pendant comprising a front and a back, wherein said necklace pendant is configured so that said back faces a user when worn and said front is for display;

a cavity positioned and configured such that it is not visible when said article of jewelry is worn;

said cavity fillable with cremated remains, hair and/or personal effects of a person or animal;

a jewelry finding disposed on said back of said necklace pendant;

an adhesive or cement and said finding to seal said cavity and to enclose the cremated remains, hair and/or personal effects of the person or animal therein;

said jewelry finding comprising a bail;

said jewelry finding disposed to cover said cavity and said adhesive or cement;

a screw; and said finding secured with said screw inserted into said adhesive or cement.

2. The keepsake article of jewelry of claim 1 wherein said necklace pendant comprises a birthstone color for a birthday of the person or animal.

3. The keepsake article of jewelry of claim 1 wherein said necklace pendant comprises a teardrop shape.

4. The keepsake article of jewelry of claim 1 wherein said necklace pendant is made of stone.

5. The keepsake article of jewelry of claim 1 wherein said necklace pendant is made of plastic.

6. The keepsake article of jewelry of claim 1 wherein said necklace pendant is made of glass.

7. The keepsake article of jewelry of claim 1 wherein said finding is made of metal.

8. The keepsake article of jewelry of claim 1 wherein said cavity is located in a narrow portion of said necklace pendant.

9. The keepsake article of jewelry of claim 1 further comprising a memento of a person or animal, in addition to the cremated remains, hair and/or personal effects of the person or animal disposed in said cavity.

10. The keepsake article of jewelry of claim 1 wherein said necklace pendant is a geometric shape.

11. The keepsake article of jewelry of claim 1 wherein said necklace pendant is a molded material.

12. The keepsake article of jewelry of claim 11 wherein said cavity is molded in said necklace pendant.

13. The keepsake article of jewelry of claim 1 wherein said cavity is drilled.

14. A kit for making a keepsake comprising the keepsake article of jewelry of claim 1, wherein said cavity provides an opening for a consumer to fill in said cavity with the cremated ashes, hair and/or personal effects of a person or animal; and user instructions.

15. A method of manufacturing a keepsake article of jewelry comprising:

obtaining cremains, hair and/or personal effects of a person or animal;

providing a necklace pendant comprising a front and a back, wherein the necklace pendant is configured so that the back faces a user when worn and the front is for display;

providing a cavity that is not visible when the necklace pendant is worn by the user;

filling the cavity with the cremains, hair and/or personal effects of the person or animal;

providing an adhesive or cement;

disposing a finding comprising a bail on the back of the necklace pendant;

sealing the cavity with the adhesive or cement and the finding to enclose the cremains, hair and/or personal effects of the person or animal;

covering the cavity and the adhesive or cement with the finding;

providing a screw; and securing the finding with the screw inserted into the adhesive or cement.

* * * * *